US007322139B2

(12) United States Patent
Holcomb

(10) Patent No.: US 7,322,139 B2
(45) Date of Patent: Jan. 29, 2008

(54) PICTURE FRAME HOLDER

(75) Inventor: Gary Lee Holcomb, Belleair Bluffs, FL (US)

(73) Assignee: Dan-Dee International, Ltd., Jersey City, NJ (US)

( * ) Notice: Subject to any disclaimer, the term of this patent is extended or adjusted under 35 U.S.C. 154(b) by 218 days.

(21) Appl. No.: 11/097,524

(22) Filed: Apr. 1, 2005

(65) Prior Publication Data

US 2006/0218838 A1 Oct. 5, 2006

(51) Int. Cl.
*A47G 1/10* (2006.01)

(52) U.S. Cl. ..... 40/700; 40/752; 40/765; 248/469; 248/473

(58) Field of Classification Search ..... 40/700, 40/790, 606.01, 607.09, 611.06, 765, 642, 40/124.04, 611.13, 611.01, 739, 741, 591, 40/593, 661, 600, 752; 248/451, 452, 153, 248/469, 473; 211/41.1, 85.2, 85.26; D6/310
See application file for complete search history.

(56) References Cited

U.S. PATENT DOCUMENTS

| | | | | | |
|---|---|---|---|---|---|
| 1,927,635 | A | * | 9/1933 | Garfunkel | 248/452 |
| 2,191,373 | A | | 2/1940 | Dankanyin | |
| D131,540 | S | * | 3/1942 | Phillips | 417/107 |
| 2,465,400 | A | * | 3/1949 | Scully | 248/441.1 |
| D153,787 | S | | 5/1949 | Goldberg | |
| D153,788 | S | | 5/1949 | Goldberg | |
| 2,533,978 | A | | 12/1950 | Versosa | |
| D166,406 | S | | 4/1952 | Minick | |
| 2,704,910 | A | * | 3/1955 | Paige | 446/388 |
| D216,805 | S | | 3/1970 | D'Amato | |
| D291,628 | S | * | 9/1987 | Poltere | D6/310 |
| 4,712,760 | A | * | 12/1987 | Winter | 248/451 |
| 5,237,763 | A | | 8/1993 | Ochoa | |
| D383,909 | S | * | 9/1997 | Salas | D6/310 |
| 5,857,278 | A | * | 1/1999 | Perkins, Jr. | 40/790 |
| 6,015,149 | A | * | 1/2000 | Burk | 273/148 A |
| D470,664 | S | | 2/2003 | Richter | |
| 6,513,779 | B2 | * | 2/2003 | Halpin | 248/451 |
| 6,574,897 | B1 | | 6/2003 | Timmer | |

* cited by examiner

*Primary Examiner*—Paul N. Dickson
*Assistant Examiner*—Rita K Sinha
(74) *Attorney, Agent, or Firm*—Amster, Rothstein & Ebenstein LLP

(57) ABSTRACT

The present invention is directed to a picture frame holder which can accommodate a picture frame in either a vertical or horizontal orientation. The picture frame holder of the present invention includes a base with a slot and a vertical support having outwardly extending appendages, each of which has both vertical and horizontal slots aligned with the slot in the base. The appendages are spaced at a distance apart from one another which is substantially equal to the smaller dimension of the frame which it is to accommodate. Thus, it is possible to slide a picture frame into the picture frame holder using the horizontal or vertical slots which will allow the picture frame to be oriented in either a horizontal or vertical orientation. It is further noted that the holder of the present invention is not limited to holding picture frames and can be designed to accommodate other rectangular objects, including but not limited to, business cards, photographs, laminated items, sports trading cards, plaques and the like.

21 Claims, 7 Drawing Sheets

PICTURE FRAME HOLDER

FIELD OF THE INVENTION

The present invention generally relates to a holder for picture frames, pictures, business cards and the like which is configured to hold the same in either a vertical or horizontal orientation notwithstanding that the frame, picture, business card, may be rectangular.

BACKGROUND OF THE INVENTION

Picture frame holders are well known in the art. Typically, these items are configured to hold a picture in either a vertical or horizontal orientation. To change the orientation of a picture in such frames, the entire picture frame holder is turned on its side. While acceptable in some frames, this method is unsuitable in frames with aesthetic designs since the design would not appear as intended if turned on its side. There is also a variety of known picture holders which include retaining pictures and their edges. For example, U.S. Design Pat. No. D216,805 shows an embodiment in which a hand shaped support engages a picture frame along its top, bottom and left edges. As shown, it does not appear possible to display a rectangular picture in both a horizontal and vertical orientation in this frame.

While the prior art is of interest, it does not provide for rotating the orientation of a picture frame (or other rectangular item) in a holder without rotating the entire holder. Thus, while useful for accommodating certain pictures and the like, prior art picture frame holders having aesthetic designs do not allow for the user to select which orientation a picture is to be housed within the holder. Thus, there is a long-felt need for a picture frame holder which allows for a picture frame to be displayed vertically or horizontally.

SUMMARY OF THE INVENTION

Accordingly, it is an object of the present invention to provide a holder for picture frames, photographs, business cards and other rectangular items which can be supported in either a vertical or horizontal orientation without rotating the holder itself.

It is another object of the present invention to provide a picture frame holder which includes a base with a horizontal slotted groove and a vertical support with outwardly extending members, wherein each outwardly extending member includes a horizontal and vertical slot which permit a picture frame (or other rectangular item) to be displayed in the picture holder in either a horizontal or vertical orientation.

It is another object of the present invention to provide a holder which will support an object such as a photograph having two opposite parallel sides where the distance between the parallel sides is in an appropriate range.

It is another object of the present invention to provide a picture frame holder which is shaped as a decorative character and which allows for horizontal and vertical display of a picture frame (or similar rectangular objects).

It is another object of the present invention to solve the shortcomings of the prior art.

Other objects will become apparent from the foregoing description.

It has now been found that the above-related objects of the invention are obtained in the form of a picture frame holder or other rectangular items which comprises a horizontal base having a top surface for supporting a picture frame and a support extending upwardly from the horizontal base. The picture frame holder further includes a first appendage which extends outwardly from the vertical support, with the first appendage including a horizontal slot and a vertical slot. Similarly, a second appendage extends outwardly from the vertical support, with the second appendage including a horizontal slot and a vertical slot. The first and second appendages are separated from each other and the base by a sufficient distance to enable the picture frame to be held in a horizontal and vertical orientation. In one embodiment, the base includes a slot which is aligned with the horizontal and vertical slots in the first and second appendages. In another embodiment, the picture frame holder of the present invention can be in the form of a decorative character, such as a bear or reindeer.

BRIEF DESCRIPTION OF THE DRAWINGS

The above and related objects, features and advantages of the present invention will be more fully understood with reference to the following detailed description of the preferred, albeit illustrative, embodiment(s) of the present invention when considered in conjunction with the accompanying figures, wherein.

DETAILED DESCRIPTION OF THE PREFERRED EMBODIMENT(S)

The present invention generally relates to a holder for retaining picture frames, photographs, business cards, trading cards or other rectangular objects in either a horizontal or vertical orientation, without rotating the holder itself.

Figure 1:
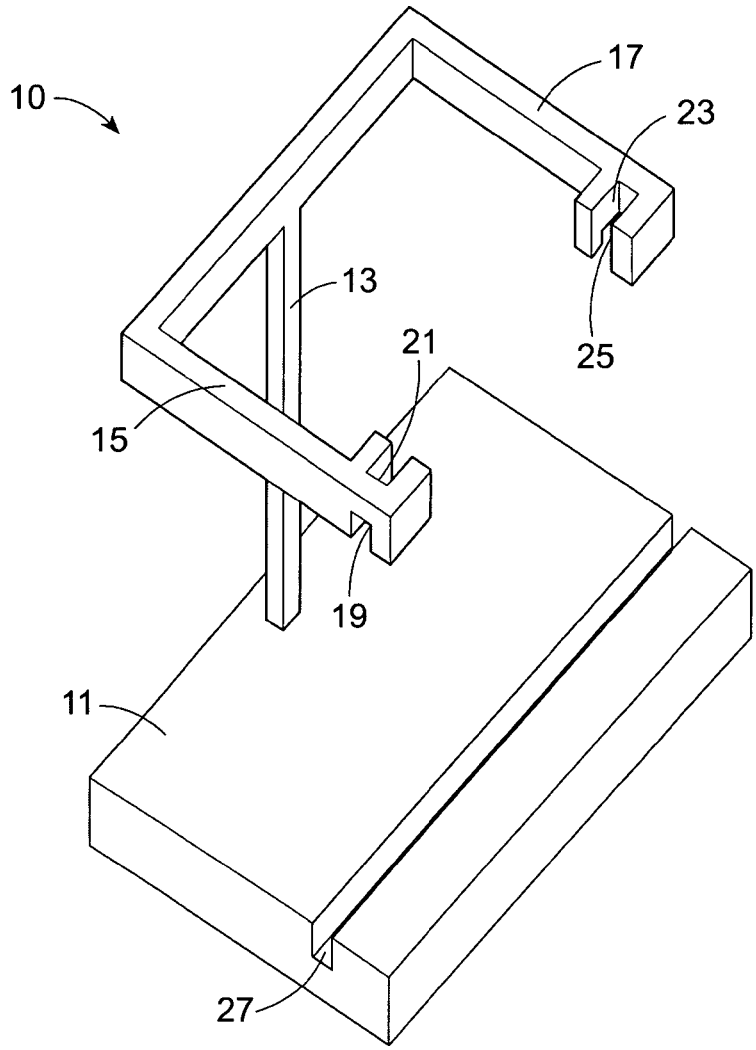
FIG. 1 is a perspective view of one embodiment of the picture frame holder of the present invention.

In one embodiment of the present invention, the holder of the present invention is a picture frame holder which holds rectangular picture frames. However, it should be understood that the holder can hold other rectangular items such as, photos, business cards, trading cards, etc. The holder 10 of the present invention includes a horizontal base 11 which preferably has a substantially flat bottom to enable the holder 10 to stand upright, as shown in FIG. 1. The horizontal base 11 includes a horizontal base slot 27 which, as described below, will be used in conjunction with other components of the holder 10 to retain the rectangular picture frame 29 shown in FIG. 2. A vertical support 13 extends from the base 11 and includes a first appendage 15 and a second appendage 17, which extend outwardly from the vertical support 13 and include at least two slots which allow a picture frame to be retained in a horizontal or vertical orientation in the holder 10 between the slots and the base slot 27.

Figure 2:
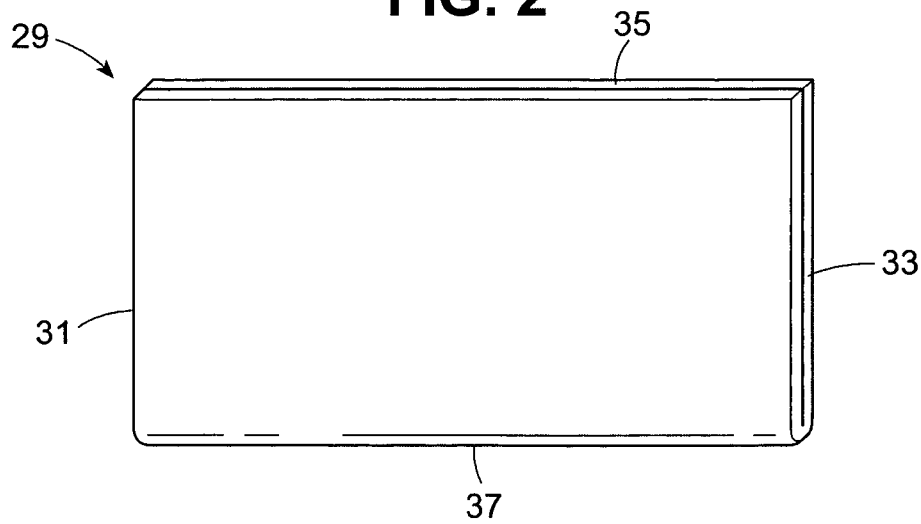
FIG. 2 is a front view of a picture frame for use with the various embodiments of the picture frame holder of the present invention.
Figure 4:
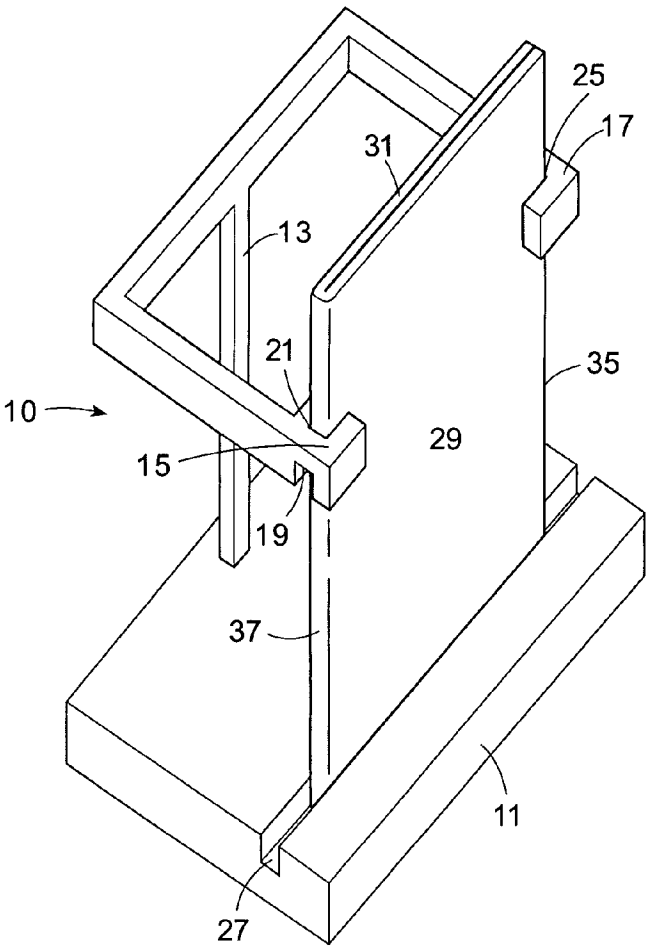
FIG. 4 is a front view of the picture frame holder of FIG. 1, wherein the picture frame of FIG. 2 is held vertically therein.
Figure 3:
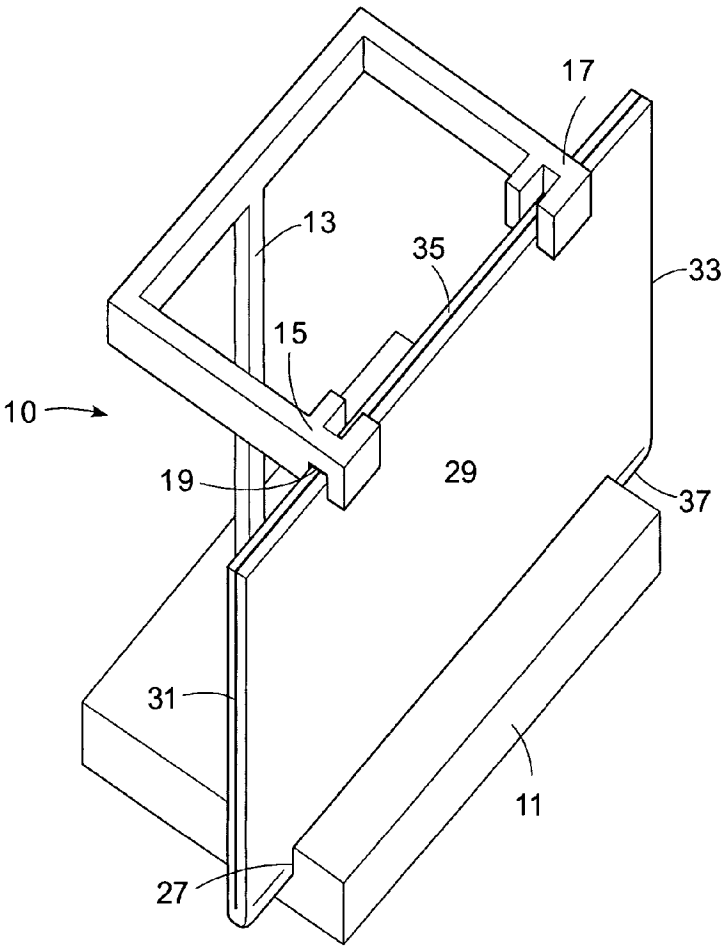
FIG. 3 is a front view of the picture frame holder of FIG. 1, wherein the picture frame of FIG. 2 is held horizontally therein.

More particularly, the first appendage 15 includes a horizontal slot 19 and a vertical slot 21 and the second appendage 17 includes a matching horizontal slot 23 and a vertical slot 25. The horizontal slots 19, 23 and vertical slots 21, 25 should be in alignment with the base slot 27 on the base 11 so that when a rectangular picture frame is inserted into these slots, it will stand upright in a horizontal or vertical orientation, as shown in FIGS. 3 and 4. Similarly, the first and second appendages 15, 17 of the vertical support 13 should be separated by a distance which will allow a picture frame 29 to be accommodated within the holder 10 in either a horizontal or vertical orientation, depending upon which set of slots are used to retain the frame 29. Preferably, the first and second appendages 15, 17 are separated by a distance which is substantially equal to the smaller dimension of the frame 29 which the picture holder 10 is to accommodate. Similarly, the first and second appendages 15, 17 should be at a height from the base 11 which is substantially equal to the smaller dimension of the frame 29 as well. Thus, where frame 29 is rectangular, it includes two shorter sides 31, 33 which are substantially parallel to each other and substantially perpendicular to longer sides 35, 37 (which are also substantially parallel to each other), as shown in FIG. 2. Thus, in this embodiment, appendages 15, 17 are separated by a distance which is substantially equal to the length of sides 31, 33. Similarly, the appendages 15, 17 are located at a height from the base 11 which is substantially equal to the length of sides 31, 33.

By arranging the components of the holder 10 in the foregoing manner, it is possible to support the picture frame 29 in the picture frame holder 10 in either a vertical or horizontal orientation. In this regard, if the picture frame 29 is to be displayed in a horizontal orientation, then the picture frame 29 is slid between base slot 27 and horizontal slot 19 of the first appendage 15 and horizontal slot 23 of the second appendage 17, as shown in FIG. 3. If the frame is to be displayed in a vertical orientation, then the picture frame 29 is slid between vertical slot 21 of the first appendage 15 and vertical slot 25 of the second appendage 17 such that the bottom of the picture frame rests in base slot 27 of base 11, as shown in FIG. 4. While it is preferable to include a base slot 27 in the base 11, the holder 10 of the present invention need not include a slot in the base 11 to work. In this regard, appendages 15, 17 would each still include a horizontal slot and vertical slot to retain a frame in a horizontal or vertical orientation, but the base will not include a horizontal slot. Thus, the bottom of the frame 29 will simply rest on the top surface of the base 11 when held by the slots of appendages 15, 17.

In a preferred embodiment, the holder 10 is designed to accommodate a 4"×6" picture frame (or other rectangular item). However, the holder 10 can be designed to accommodate picture frames and other rectangular items having different dimensions (e.g., 2"×3.5", 5"×7", 8"×10", etc.). Additionally, the holder 10 can be designed to accommodate items having other shapes, such as an oval, trapezoid, parallelogram or substantially any shape having two parallel sides. Additionally, the base slot 27, horizontal slots 19, 23 and vertical slots 21, 25 should be of a sufficient width to accommodate picture frames of varying thicknesses.

Figure 5:
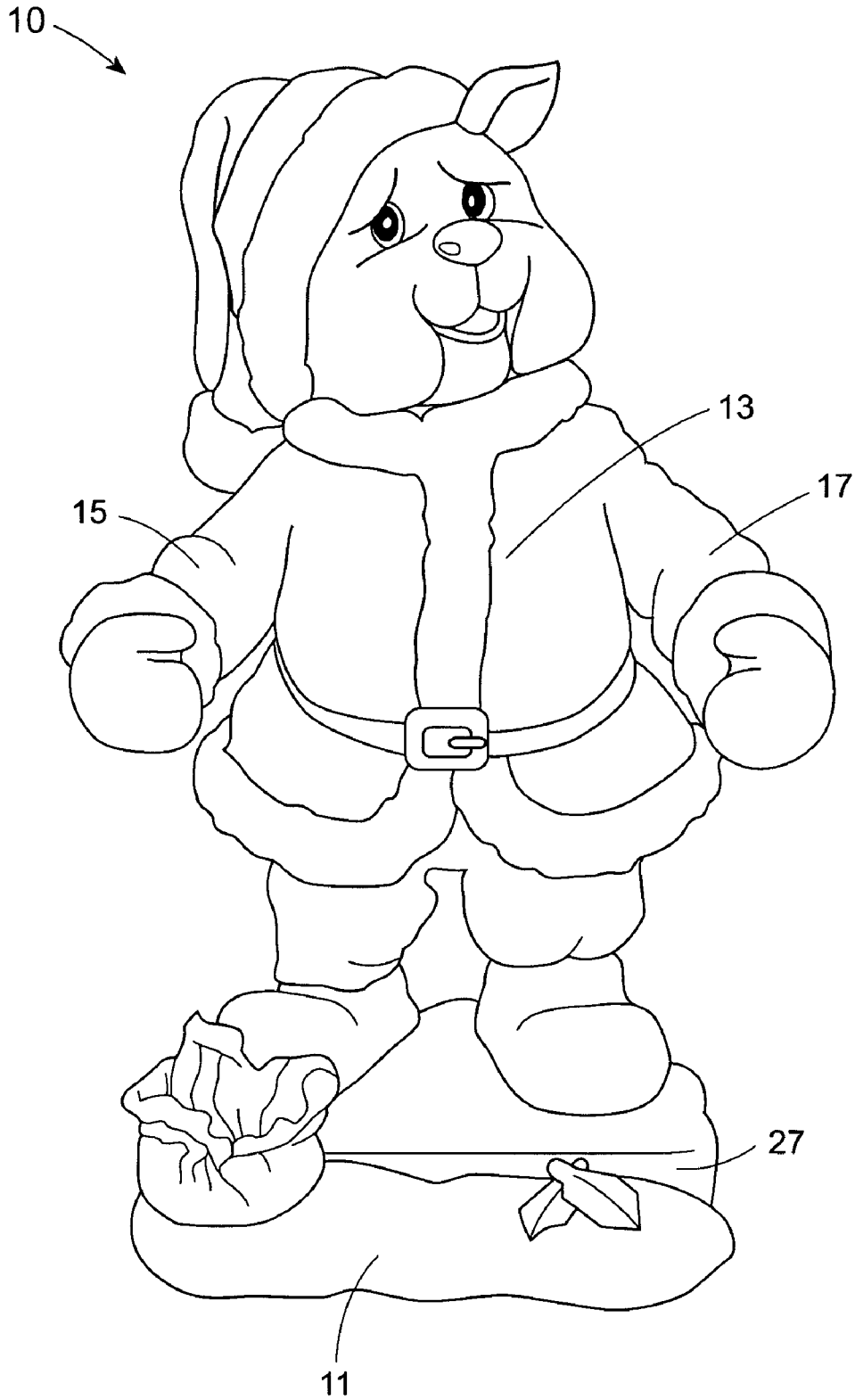
FIG. 5 is a front view of a second embodiment of the picture frame holder of the present invention.
Figure 6:
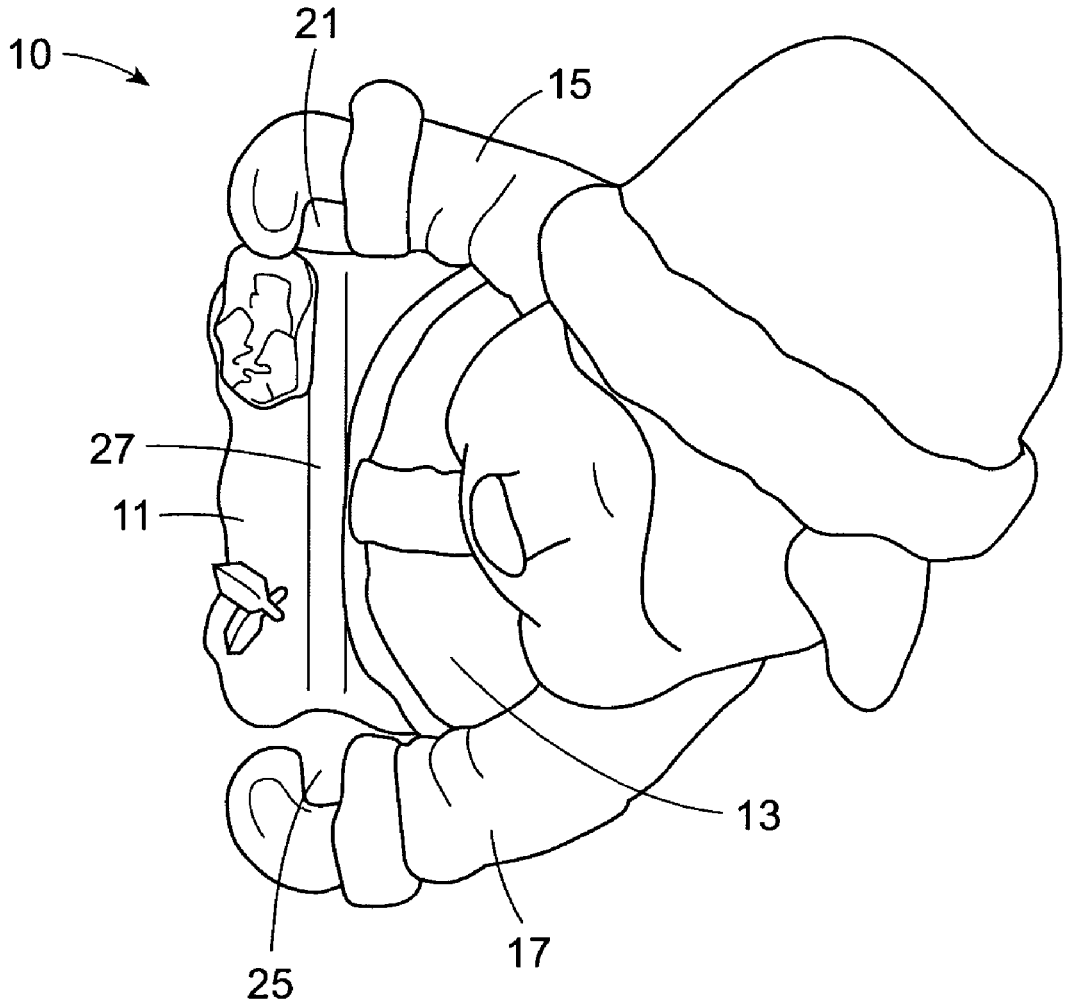
FIG. 6 is a plan view of the picture frame holder shown in FIG. 5.
Figure 7:
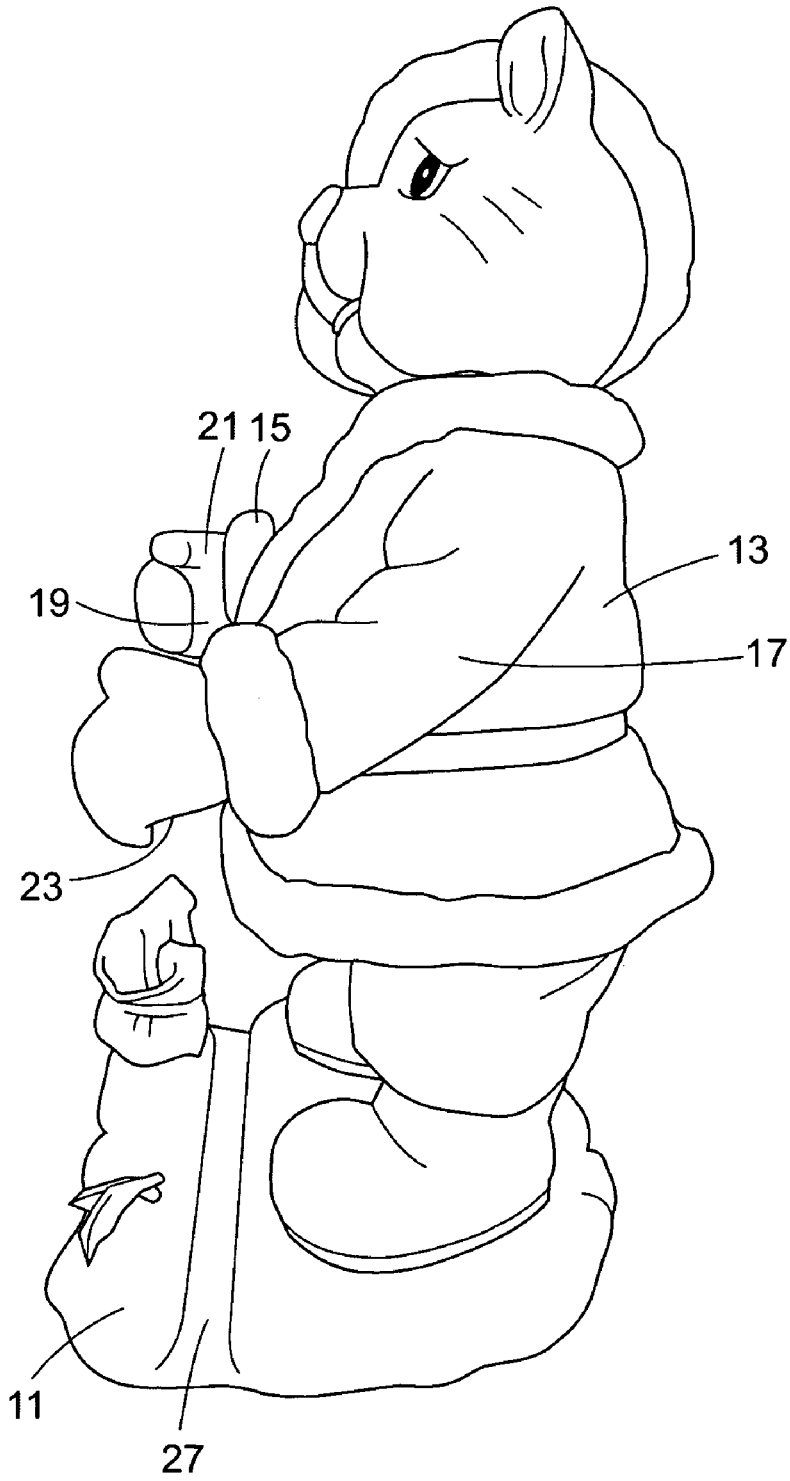
FIG. 7 is a side view of the picture frame holder shown in FIGS. 5 and 6.
Figure 8:
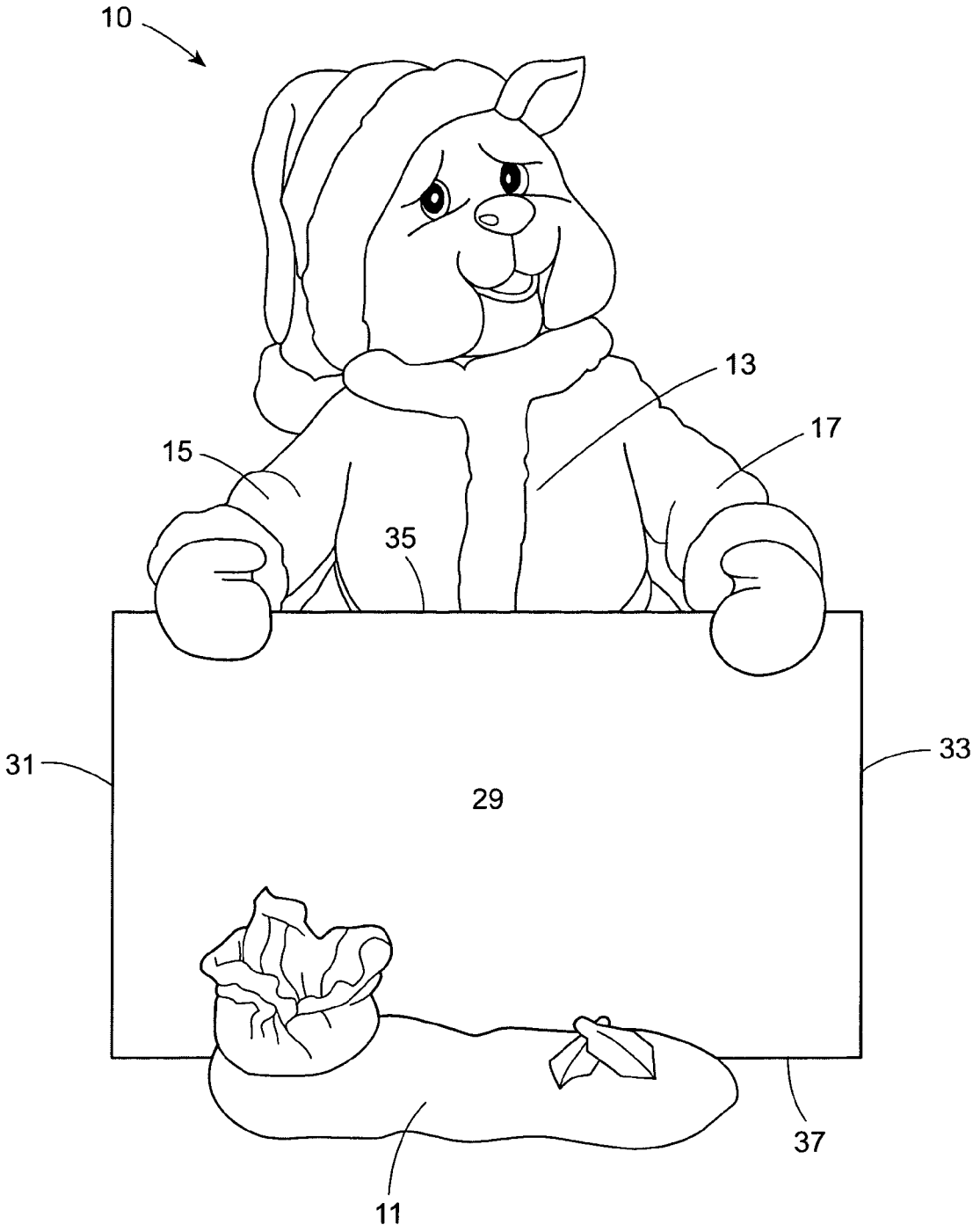
FIG. 8 is a front view of the picture frame holder shown in FIGS. 5-7, wherein the picture frame shown in FIG. 2 is held horizontally therein.
Figure 9:
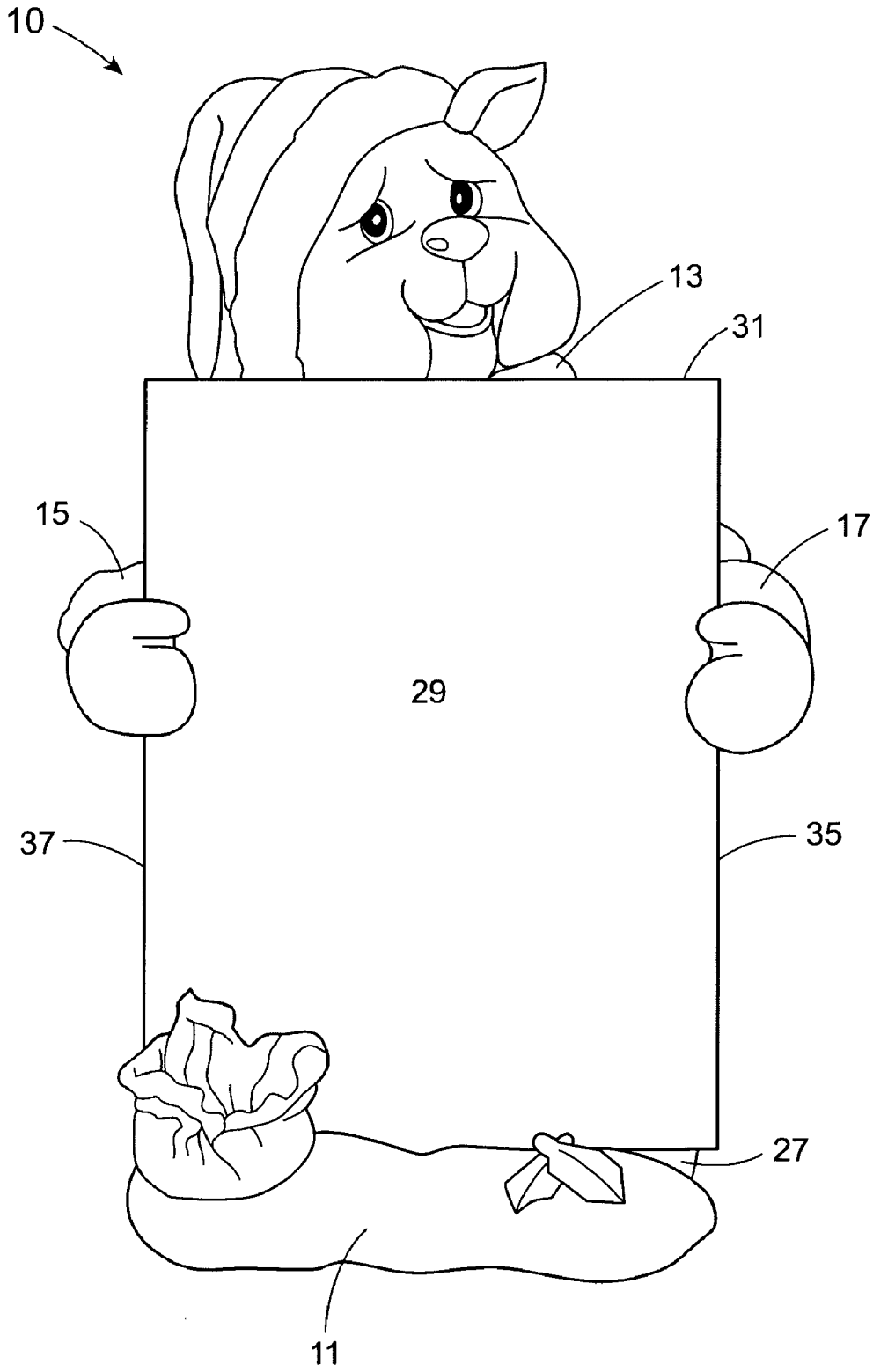
FIG. 9 is a front view of the picture frame holder shown in FIGS. 5-7, wherein the picture frame shown in FIG. 2 is held vertically therein.

In a preferred embodiment, the vertical support 13 is shaped as a decorative character, such as, for example, a bear dressed as Santa Claus or a reindeer. In this embodiment, the body (e.g., feet, legs, torso, head) of the bear is the vertical support 13 and the arms of the bear are the first and second appendages 15 and 17, as shown in FIG. 5. In this embodiment, the horizontal slots 19, 23 and vertical slots 21, 25 are configured as part of the hands of the bear, as shown in FIGS. 6 and 7. The base 11 is represented as a pile of snow upon which the bear is standing and includes a horizontal base slot 27. An acrylic picture frame 29, such as the one shown in FIG. 2, can then be inserted into the slots in the hands of the bear horizontally or vertically by the methods described herein, as shown in FIGS. 8, 9. Additionally, the frame 29 can be double sided such that pictures can be displayed on its front and back sides. In this embodiment, the picture holder 10 is polyresin, but could also be made of other materials, including, but not limited to, ceramic, wood, metal, plastic and the like. Similarly, the picture frame could be made from acrylic, plastic, glass or any other suitable material.

Additionally, the picture frame holder 10 of the present invention could be designed to hold any other similarly shaped objects, including, for example, a photograph without a frame, a business card, trading card, a laminated photo, a plaque, etc. or any other similarly shaped item. Of course, the dimensions of the holder 10 should be varied to accommodate objects of smaller or larger dimensions.

In one embodiment, the appendages 15, 17 can be coupled to the vertical support such that their height from the base 11 and the distance separating these members can be manually adjusted. For example, the appendages 15, 17 can be coupled to the vertical support by cam and gear assemblies, cable and pulley assemblies, slide rails, pivot rods or the like. Similarly, the appendages 15, 17 may be made of a pliable material, such as plastic with a wire core, thin metal or similar pliable materials which can be bent in varying directions to change their dimensions.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims and not by the foregoing specification.

What is claimed is:

1. A picture frame holder comprising:

a horizontal base comprising a top surface for supporting a picture frame;

a vertical support extending upwardly from the horizontal base;

a first appendage extending outward from the vertical support, wherein the first appendage comprises a horizontal slot and a vertical slot;

a second appendage extending outward from the vertical support, wherein the second appendage comprises a horizontal slot and a vertical slot; and wherein said first and second appendages are separated from each other and from the base by a sufficient distance to enable the picture frame to be held in a horizontal and vertical orientation relative to the base.

2. The picture frame holder of claim 1, wherein said first and second appendages are separated by a distance which is substantially equal to a narrower dimension of the frame which is to be accommodated within said frame holder.

3. The picture frame holder of claim 1, wherein said first and second appendages are positioned at a height above said base which is substantially equal to a narrower dimension of the frame which is to be accommodated within said picture frame holder.

4. A picture frame holder of claim 1, further comprising a slot in the top of said horizontal base.

5. The picture frame holder of claim 4, wherein said horizontal and vertical slots on said first and second appendages are aligned with the slot in the base.

6. The picture frame holder of claim 4, wherein said slot in said base, said horizontal and vertical slot in said first appendage and said horizontal and vertical slot in said second appendage are of a sufficient width to accommodate frames of varying thicknesses.

7. The picture frame holder of claim 1, wherein said vertical support is shaped as a decorative character.

8. The picture frame holder of claim 1, wherein said picture frame holder is made from any one or more of the following materials: polyresin, ceramic, wood, metal and plastic.

9. The picture frame holder of claim 7, wherein said character comprises a first hand with a vertical and horizontal slot at the distal end of said first appendage, and a second hand with a vertical and horizontal slot at the distal end of said second appendage.

10. The picture frame holder of claim 1, wherein said frame comprises any one of the following shapes: rectangular, oval, parallelogram and trapezoid.

11. A holder of a rectangular item comprising:

a horizontal base comprising a top surface for supporting a rectangular item;

a vertical support extending from the horizontal base;

a first appendage extending outward from the vertical support, wherein the first appendage comprises a horizontal slot and a vertical slot;

a second appendage extending outward from the vertical support, wherein the second appendage comprises a horizontal slot and a vertical slot; and wherein said first and second appendages are separated from each other and from the base by a sufficient distance to enable the rectangular item to be held in either a horizontal or vertical orientation relative to the base.

12. The rectangular item holder of claim 11, wherein said first and second appendages are separated by a distance which is substantially equal to a narrower dimension of the rectangular item which is to be accommodated within said holder.

13. The holder of claim 11, wherein said first and second appendages are positioned at a height which is substantially equal to a narrower dimension of the rectangular item which is to be accommodated within said rectangular item holder.

14. The rectangular item holder of claim 11, wherein said horizontal and vertical slots on said first and second appendages are aligned with a slot in the base.

15. The rectangular item holder of claim 14 , wherein said slot in said base, said horizontal and vertical slot in said first appendages and said horizontal and vertical slot in said second appendages are of a sufficient width to accommodate frames of varying thicknesses.

16. The rectangular item holder of claim 11, wherein said vertical support is shaped as a decorative character.

17. The rectangular item holder of claim 11, wherein said rectangular item holder is made from any one or more of the following materials: polyresin, ceramic, wood, metal and plastic.

18. The rectangular item holder of claim 16, wherein said character comprises a first hand with a vertical and horizontal slot at the distal end of said first appendage, and a second hand with a vertical and horizontal slot at the distal end of said second appendage.

19. The rectangular item holder of claim 13, wherein said rectangular item comprises one or more of the following: a photograph, a laminated picture, a business card, a sports trading card, a plaque, cardboard, paper, glass and plastic.

20. The rectangular item holder of claim 13, wherein said first and second appendages are adjustable to conform to the dimensions of the rectangular item to be held in said holder.

21. A picture frame holder comprising:

a base;

a vertical support extending from the base;

a first appendage extending outward from the vertical support, wherein the first appendage comprises a horizontal slot and a vertical slot;

a second appendage extending outward from the vertical support, wherein the second appendages comprise a horizontal slot and a vertical slot; and wherein said first and second appendages are separated from each other and from the base by a sufficient distance to enable the picture frame to be held in a horizontal and vertical orientation relative to the base and between said horizontal slots or between said vertical slots.

* * * * *